US010895060B2

(12) United States Patent
Manchester

(10) Patent No.: US 10,895,060 B2
(45) Date of Patent: Jan. 19, 2021

(54) UNDERWATER TRENCHING APPARATUS AND PUMPING APPARATUS

(71) Applicant: Royal IHC Limited, Stocksfield (GB)

(72) Inventor: Jonathan Ralph Manchester, Stocksfield (GB)

(73) Assignee: Royal IHC Limited, Stocksfield (GB)

( * ) Notice: Subject to any disclaimer, the term of this patent is extended or adjusted under 35 U.S.C. 154(b) by 122 days.

(21) Appl. No.: 15/747,337

(22) PCT Filed: Jul. 25, 2016

(86) PCT No.: PCT/GB2016/052277

§ 371 (c)(1),
(2) Date: Jan. 24, 2018

(87) PCT Pub. No.: WO2017/017431

PCT Pub. Date: Feb. 2, 2017

(65) Prior Publication Data

US 2018/0216312 A1 Aug. 2, 2018

(30) Foreign Application Priority Data

Jul. 30, 2015 (GB) ..... 1513484.4

(51) Int. Cl.
*E02F 3/92* (2006.01)
*E02F 5/10* (2006.01)
(Continued)

(52) U.S. Cl.
CPC ..... *E02F 3/9206* (2013.01); *E02F 3/90* (2013.01); *E02F 5/02* (2013.01); *E02F 5/107* (2013.01);
(Continued)

(58) Field of Classification Search
CPC ... E02F 3/9206; E02F 3/90; E02F 5/02; E02F 5/107; F04B 23/04; F04B 49/065; F04F 5/54
See application file for complete search history.

(56) References Cited

U.S. PATENT DOCUMENTS 2,112,651 A 3/1938 Fox
2,669,941 A * 2/1954 Stafford ..... F04F 1/10 417/125
(Continued)

FOREIGN PATENT DOCUMENTS

EP 1167637 A2 1/2002
GB 1102967 A 2/1968
(Continued)

OTHER PUBLICATIONS

Gibson I H, "Control of Series and Parallel Centrifugal Pumps," Technical Paper of ISA, Instrument Society of America, Oct. 1, 1995, pp. 1253-1260, vol. 50, No. Part 03, ISSN 1054-0032.

*Primary Examiner* — Jamie L McGowan
(74) *Attorney, Agent, or Firm* — E. Eric Mills; Nexsen Pruet, PLLC

(57) ABSTRACT

An underwater trenching apparatus and pumping apparatus includes: first and second pumps and a trench-cutting jetting tool with first and second sections, the first pump having an inlet for fluid connection with a source of water and an outlet fluidly connected to the first section of the jetting tool, the second pump having an inlet for fluid connection with a source of water and an outlet fluidly connected to the second section of the jetting tool, wherein the outlet of the first pump is fluidly connected to the inlet of the second pump by valve means that is operable to divert at least a portion of an outlet flow of the first pump to the inlet of the second pump.

25 Claims, 4 Drawing Sheets

(51) Int. Cl.

| | |
|---|---|
| ***E02F 3/90*** | (2006.01) |
| ***F04B 23/04*** | (2006.01) |
| ***F04B 49/06*** | (2006.01) |
| ***E02F 5/02*** | (2006.01) |
| ***F04F 5/54*** | (2006.01) |

(52) U.S. Cl.
CPC ..... *F04B 23/04* (2013.01); *F04B 49/065* (2013.01); *F04F 5/54* (2013.01)

(56) References Cited

U.S. PATENT DOCUMENTS

| | | | | | |
|---|---|---|---|---|---|
| 3,005,417 | A * | 10/1961 | Swaney | F04F 1/10 | 417/125 |
| 3,552,884 | A * | 1/1971 | Faldi | E02F 3/90 | 417/122 |
| 4,253,255 | A * | 3/1981 | Durell | E02F 3/90 | 37/195 |
| 4,353,174 | A * | 10/1982 | Maloblocki | E02F 3/90 | 37/308 |
| 6,189,243 | B1 * | 2/2001 | Oikawa | E02F 3/88 | 37/195 |
| 6,705,029 | B2 * | 3/2004 | Anderson | E02F 5/105 | 226/170 |

FOREIGN PATENT DOCUMENTS

| | | | |
|---|---|---|---|
| JP | S56-077586 | A | 6/1981 |
| JP | 2000013947 | A | 1/2000 |
| JP | 2015500954 | A | 1/2015 |
| WO | 2013093492 | A1 | 6/2013 |

* cited by examiner

UNDERWATER TRENCHING APPARATUS AND PUMPING APPARATUS

CROSS REFERENCE TO RELATED APPLICATIONS

This application is a 35 U.S.C. § 371 U.S. national phase entry of International Application No. PCT/GB2016/052277 having an international filing date of Jul. 25, 2016, which claims the benefit of Great Britain Application No. 1513484.4 filed Jul. 30, 2015, each of which is incorporated herein by reference in its entirety.

This invention relates to underwater trenching apparatus and pumping apparatus. More specifically, although not exclusively, this invention relates to a pumping apparatus whose configuration is adjustable to provide cumulative pumping pressures from multiple pumps into predetermined sections of a jetting tool, for example a trench-cutting high pressure jetting tool.

BACKGROUND

Trench cutting apparatus using high pressure water jets to form the trench are known in the subsea environment. To supply water at high pressure to the outlet(s) of a jetting tool, one or more pumps are used to pump water from the environment around the jetting tool.

It is known that seabed characteristics can vary widely. Current trenching apparatus tend to vary the duty point of the pump or pumps by progressively closing the supply to the outlet jets. Whilst such arrangements are useful in many circumstances, the jetting pressures are limited to the outlet pressure range of the or each pump.

The applicants have observed that in many cases cutting through loose sands and weak clays can require low jetting pressures and high flow rates, while cutting through strong clays and hard soils require higher jetting pressures but often without the need for high flow rates.

The present invention seeks, inter alia, to provide a solution that enables greater flexibility in trenching operations. It is a more specific aim of the present invention to provide an improved trenching apparatus.

BRIEF SUMMARY OF THE DISCLOSURE

In accordance with a first aspect of the present invention there is provided an underwater trenching apparatus comprising first and second pumps and a trench-cutting jetting tool with first and second sections, the first pump having an inlet for fluid connection with a source of fluid, e.g. water, and an outlet fluidly connected to the first section of the jetting tool, the second pump having an inlet for fluid connection with a source of fluid, e.g. water and an outlet fluidly connected to the second section of the jetting tool, wherein the outlet of the first pump is fluidly connected to the inlet of the second pump by valve means that is operable to divert, in use, at least a portion of an outlet flow of the first pump to the inlet of the second pump, e.g. in order to increase the pressure of the outlet flow of the second pump.

According to a second aspect of the present invention there is provided a pumping apparatus, e.g. for use in an underwater trenching apparatus, comprising a first pump having an inlet for fluid connection with a source of fluid, e.g. a gas or a liquid such as water, and an outlet for fluid connection to the first section of a jetting tool and a second pump having an inlet for fluid connection with a source of fluid, e.g. a gas or a liquid such as water, and an outlet for fluid connection to the second section of a jetting tool, wherein the outlet of the first pump is fluidly connected to the inlet of the second pump by valve means that is operable to divert, in use, at least a portion of an outlet flow of the first pump, for example from the first section of the jetting tool, to the inlet of the second pump, e.g. in order to increase the pressure of the outlet flow of the second pump.

By diverting outlet flow of the first pump to the inlet of the second pump, fluid pressure supplied to the second section of the jetting tool can be increased beyond that which is achievable by the second pump when it is fed exclusively by the source.

The apparatus may comprise a third pump, which may have an inlet for fluid connection with a source of liquid and/or an outlet fluidly connected to or for fluid connection with a third section of the or a jetting tool. The valve means may comprise a first valve means. The outlet of the first and/or second pump(s) may be fluidly connected to the inlet of the third pump by the or a further valve means, e.g. the first or a second valve means, of the apparatus, which may be operable to divert at least a portion of an outlet flow of the first and/or second pump(s) to the inlet of the third pump. The apparatus may comprise a fourth and/or subsequent pump. The fourth or subsequent pump may have an inlet for fluid connection with a source of liquid and/or an outlet fluidly connected to or for fluid connection with a fourth or subsequent section of the or a jetting tool. The outlet of the first and/or second and/or third pump(s) may be fluidly connected to the inlet of the fourth pump by the or a yet further valve means of the apparatus, which may be operable to divert at least a portion of an outlet flow of the first and/or second and/or third pump(s) to the inlet of the fourth pump. Similarly, the outlet of the first and/or second and/or third and/or fourth pump(s) may be fluidly connected to the inlet of the subsequent pump by the or yet another valve means of the apparatus, which may be operable to divert at least a portion of an outlet flow of the first and/or second and/or third and/or fourth pump(s) to the inlet of the subsequent pump.

For the avoidance of doubt, the apparatus is able to be used with a jetting tool having fewer sections than pumps. In such embodiments, outlet flow from the additional pumps may be prevented until such time as they are required to be diverted to the inlet(s) of one or more other pump(s). In some embodiments, the apparatus may be configured such that the outlet of the second pump is fluidly connected to the inlet of the first pump by valve means, e.g. the second valve means. In fact, the apparatus may be configured such that each of two or more pumps is connected to each and every other pump, for example to enable the supply of increased pressure to any section of the jetting tool or a jetting tool to which the apparatus is connected.

The or at least one of the valve means may be adjustable, in use, to change or vary the proportion of the outlet flow that is diverted. In embodiments, the or at least one of the valve means may be continuously or step-wise adjustable, for example to cause, in use, a first proportion of the outlet flow to be supplied to the relevant section of the jetting tool and/or a second proportion of the outlet flow to be supplied to the inlet of the other, e.g. second, third or fourth, pump. The or at least one of the valve means may comprise a mixing valve, e.g. a three-way mixing valve. In embodiments, the valve means comprises a four-way valve or any arrangement enabling the flow to be diverted as required.

In embodiments, the or at least one of the valve means may be operable to close, in use, the fluid connection between the outlet of the pump and the relevant section of the jetting tool before or as a fluid connection is opened between the outlet of the pump and the inlet of the other, e.g. second, third or fourth, pump. The or at least one of the valve means may comprise a directed flow or plug valve, e.g. a three-way directed flow or plug valve.

At least one, preferably all, of the valve means may comprise or each comprise one or more valves, for example one or more three-way valves. The or each valve may be manually operated, for example via a handle, lever or wheel thereof. Additionally or alternatively, the or each valve may comprise and/or be operated by an actuator, for example a power-driven or automatic or automated actuator. The actuator may be operated mechanically and/or electromechanically and/or pneumatically and/or hydraulically and/or electronically.

The apparatus may comprise a control means, for example a controller, control system, control unit or control module. The control means may be operatively connected to and/or configured to operate and/or control one or more or each pump and/or one or more or each valve actuator, for example one or more operating parameters thereof. The operative connection between the control means and the pump(s) and/or the valve actuator(s) may be a wired or a wireless connection. The or each pump and/or valve actuator may be operatively connected to and controllable automatically by the control means.

The apparatus or valve means may comprise a check valve means, which may have an inlet for fluid connection with the source and an outlet for fluid connection with the inlet of the second pump. The check valve means may be configured or operable to allow fluid flow from the source to the inlet of the second pump and/or to prevent fluid flow to or toward the source. In embodiments where the apparatus comprises a third pump, the apparatus may comprise a second check valve means with an inlet for fluid connection with the source and an outlet for fluid connection with the inlet of the third pump. The second check valve means may be configured or operable to allow fluid flow from the source to the inlet of the third pump and/or to prevent fluid flow to or toward the source. In embodiments where the apparatus comprises a fourth or subsequent pump, the apparatus may comprise a third or subsequent check valve means with an inlet for fluid connection with the source and an outlet for fluid connection with the inlet of the fourth or subsequent pump. The third or subsequent check valve means may be configured or operable to allow fluid flow from the source to the inlet of the fourth or subsequent pump and/or to prevent fluid flow to or toward the source.

The source of fluid of or for the first pump and/or the source of fluid of or for the second pump may comprise a relatively low pressure fluid source. The outlet of the first pump and/or the outlet of the second pump may comprise a relatively high pressure fluid output. The apparatus may comprise means operable, e.g. where the ambient pressure is insufficient substantially to prevent cavitation in the first or second pump, to locally increase the pressure at the inlet thereof.

The apparatus may comprise a pressure boost means, e.g. a pressure booster. The pressure boost means may be comprised in or operatively connected to the inlet of the first pump and/or may be comprised in or operatively connected to the inlet of the second pump. The pressure boost means may comprise or provide the means operable to locally increase the pressure. The apparatus may comprise a pressure boost means associated with each pump, for example the inlet of each pump. Alternatively, the apparatus may comprise a single pressure booster associated with all pumps.

In preferred embodiments the apparatus comprises a jet pump, for example the pressure boost means or the means operable to locally increase the pressure may comprise a jet pump. Preferably the jet pump has an input and an output. The input may be in fluid communication with the outlet of at least one of the first and second pumps. The output may be in fluid communication with the inlet of at least one of the first and second pumps. The pressure boost means may comprise an arrangement similar to that which is disclosed in EP2795126, the contents of which are incorporated herein by reference.

The apparatus may further comprise an isolator, which may be operable to isolate the jet pump from the high pressure outlet of the primary pump. Additionally or alternatively, the apparatus may comprise one or more valves, for example controllable flow restricting valves, which may be upstream of the outlet of the first pump and/or upstream of the outlet of the second pump. At least one of the valves may have a flow restricting condition and a non-flow restricting condition. The flow restricting condition may operatively reduce, in use, the inlet flow to the pump and/or increase the exhaust pressure at the pump outlet, as compared to the non-flow restricting condition.

The inlet of the or each pump may be fluidly connected to the or each source via a feed line. In embodiments, the inlet of each pump is fluidly connected to a single source, for example via a respective feed line. In embodiments, the inlet of each pump is fluidly connected to a respective source via respective feed line. The valve means may fluidly connect the outlet of the first pump to the feed line of the second pump. The or the further valve means may fluidly connect the outlet of the first pump to the feed line of the second pump. The or the yet further valve means may fluidly connect the outlet of the first pump to the feed line of the second pump. The check valve means may be incorporated in the feed line and/or located upstream of the connection between the valve means and the feed line of the second pump.

The connection between the or each source and the or each pump or check valve means or feed line may comprise an intake. The or each intake may comprise a filtration means or filter, for example a strainer or the like, for example to prevent the take up of any debris. In embodiments, the connection between the or each source and the or each pump or check valve means or feed line may comprise in intake filtration means or filter.

Another aspect of the invention provides a method of operating an underwater trenching apparatus, e.g. as described above, the method comprising diverting at least a portion of the outlet flow of a first pump from the first section of a jetting tool to the inlet of a second pump fluidly connected to a second section of the jetting tool in order to increase the pressure of the outlet flow of the second pump supplied to the second section of the jetting tool.

The method may further comprise diverting at least a portion of the outlet flow of the second pump from the second section of the jetting tool to the inlet of a third pump fluidly connected to a third section of the jetting tool in order to increase the pressure of the outlet flow of the third pump supplied to the third section of the jetting tool. The method may further comprise diverting at least a portion of the outlet flow of the third pump from the third section of the jetting tool to the inlet of a fourth or subsequent pump fluidly connected to a fourth or subsequent section of the jetting tool in order to increase the pressure of the outlet flow of the fourth or subsequent pump supplied to the fourth or subsequent section of the jetting tool.

The method may comprise diverting a portion or only some, e.g. not all, of the outlet flow of the first pump, for example such that a portion of the outlet flow is supplied to the first section of the jetting tool and a further portion of the outlet flow is supplied to the inlet of the second pump. Similarly, the method may comprise diverting a portion or only some, e.g. not all, of the outlet flow of one or more of the second, third or fourth pump. The method may comprise varying the portion or proportion or amount of the outlet flow that is diverted, for example over a period of time, e.g. a predetermined period of time. The method may comprise varying the portion or proportion or amount of the outlet flow that is diverted in response to a command received by a user and/or according to varying requirements.

The method may comprise closing a fluid connection between the outlet of the first pump and the first section of the jetting tool and opening fluid communication between the outlet of the first pump and the inlet of the second pump. The method may comprise closing the fluid connection between the outlet of the first pump and the first section of the jetting tool before opening fluid communication between the outlet of the first pump and the inlet of the second pump. Similarly, the method may comprise closing a fluid connection between the outlet of one or more of the second, third or fourth pump and the relevant section of the jetting tool and opening fluid communication between the outlet and the inlet of the relevant subsequent pump. The method may comprise closing the fluid connection between the outlet and the relevant section of the jetting tool before opening fluid communication between the outlet thereof and the inlet of the subsequent pump.

In embodiments, the method comprises diverting the outlet flow, e.g. all of the outlet flow, of the first pump, for example such that it is supplied to the inlet of the second pump. Similarly, the method may comprise the outlet flow, e.g. all of the outlet flow, of the one or more of the second, third or fourth pump, for example such that it is supplied to the inlet of the third, fourth or subsequent pump.

The method may comprise diverting manually or automatically the outlet flow portion or diverting the outlet flow portion using manual or automated means, for example a manual or automated actuator. In embodiments, the method comprises diverting the outlet flow portion of one or more of the pumps using a control means.

The method may comprise allowing fluid flow from a source of fluid, e.g. water, to the inlet of the second pump, for example before the outlet flow portion of the first pump is diverted thereto. The method may comprise preventing fluid flow to or toward the or a source of fluid from the inlet of the second pump, for example as the outlet flow portion of the first pump is diverted thereto. Similarly, the method may comprise allowing fluid flow from the or a source of fluid, e.g. water, to the inlet of one or more of the third, fourth or subsequent pumps and/or preventing fluid flow thereto or theretoward.

The method may comprise increasing, e.g. locally, the pressure of a fluid flow to the inlet of the first and/or second pump, for example to inhibit cavitation thereof. The method may comprise increasing, e.g. locally, the pressure of a fluid flow from the or a source of relatively low pressure fluid where the ambient pressure is insufficient substantially to prevent cavitation in the first and/or second pump. The method may comprise the use of a pressure boosting means, e.g. a pressure booster such as a jet pump or the like.

For the avoidance of doubt, any of the features described herein apply equally to any aspect of the invention. For example, the underwater trenching apparatus may comprise any one or more features of the pumping apparatus relevant thereto and vice versa and/or the method may comprise any one or more features or steps relevant to one or more features of the underwater trenching apparatus or the pumping apparatus.

A further aspect of the invention provides a computer program element comprising computer readable program code means for causing a processor to execute a procedure to implement the aforementioned method. A yet further aspect of the invention provides the computer program element embodied on a computer readable medium. A yet further aspect of the invention provides a computer readable medium having a program stored thereon, where the program is arranged to make a computer execute a procedure to implement the aforementioned method.

A yet further aspect of the invention provides a control means or control system or controller comprising the aforementioned computer program element or computer readable medium.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described by way of example only with reference to the accompanying drawings in which.

DETAILED DESCRIPTION

Figure 1:
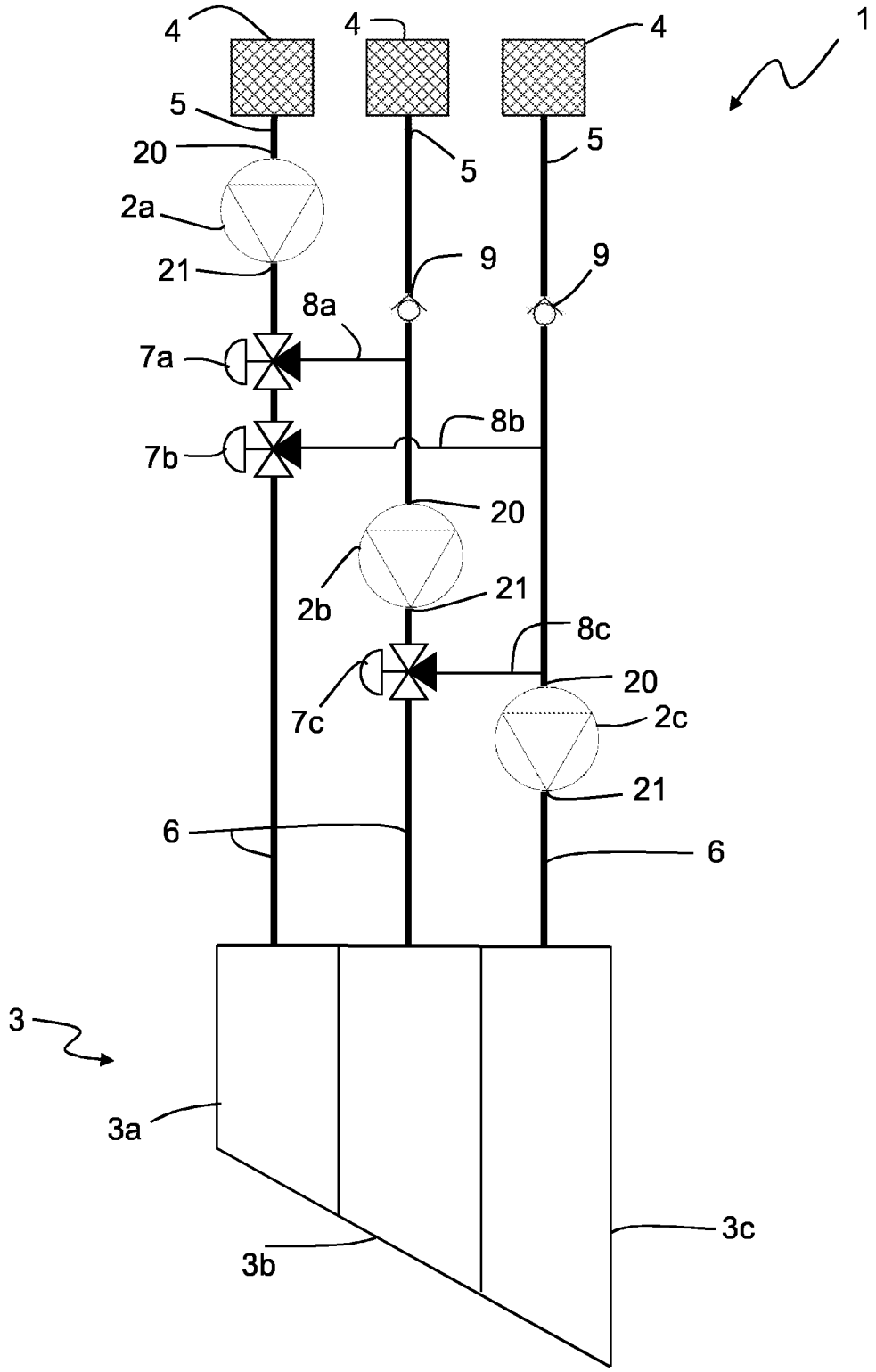
FIG. 1 is a schematic representation of an underwater trenching apparatus according to an embodiment of the invention shown in a first mode of operation configured for cutting through substrates incorporating loose sands and weak clays.

Referring now to FIG. 1, there is shown an underwater trenching apparatus 1 including first, second and third pumps 2*a*, 2*b*, 2*c* and a jetting tool leg or sword 3 including upper, middle and lower sections 3*a*, 3*b*, 3*c*. Although only one is shown, the jetting tool may include multiple jet cutting legs 3, each including upper, middle and lower sections 3*a*, 3*b*, 3*c*. It will be appreciated by one skilled in the art that the references below to the jet cutting leg 3 and sections 3*a*, 3*b*, 3*c* thereof apply equally to embodiments with multiple jet cutting legs 3 each including sections 3*a*, 3*b*, 3*c*. The pumps 2*a*, 2*b*, 2*c* are of a known type and are preferably single stage pumps.

In use, pressurised water supplied to each section 3*a*, 3*b*, 3*c* is evacuated from its respective outlet to cut trenches or holes in suitable adjacent substrates, for example a sea bed consisting of sand and/or clay and/or soil.

Each of the three pumps 2*a*, 2*b*, 2*c* includes an inlet 20 and an outlet 21, where each inlet 20 is fluidly connected to an intake 4 via a feed line 5. The intakes 4 are disposed within a source of water and each includes a filter for preventing debris from entering the feed line 5 and hence, subsequently, any of the pumps 2*a*, 2*b*, 2*c*.

The outlet 21 of each of the pumps 2*a*, 2*b*, 2*c* is fluidly connected to a respective section 3*a*, 3*b*, 3*c* via a delivery line 6. Thus, the first pump 2*a* is fluidly connected to the upper section 3*a*, the second pump 2*b* is fluidly connected to the middle section 3*b* and the third pump 2*c* is fluidly connected to the lower section 3*a*.

The delivery line 6 connecting the first pump 2*a* to the upper section 3*a* includes first and second three-way valves 7*a*, 7*b* connected in series. The first valve 7*a* is fluidly connected to the feed line 5 of the second pump 2*b* via a first diversion line 8*a*. The second valve 7*b* is downstream of the first valve 7*a* and is fluidly connected to the feed line 5 of the third pump 2*c* via a second diversion line 8*b*. The delivery line 6 connecting the second pump 2*b* to the middle section 3*b* includes a third three-way valve 7*c*, which is fluidly connected to the feed line 5 of the third pump 2*c* via a third diversion line 8*c*.

Non-return valves 9 are included in the feed lines 5 of the second and third pumps 2*b*, 2*c*, upstream of the respectively connected diversion lines 8*a*, 8*b*. Each non-return valve 9 is configured to allow fluid flow from the intake 4 to the relevant pump 2*b*, 2*c*, but to prevent fluid flow in the opposite direction.

The first, second and third three-way valves 7*a*, 7*b*, 7*c* are operatively connected to a remotely located controller (not shown), via wireless or wired communication means. The controller may then be operated to adjust remotely the three-way valves 7*a*, 7*b*, 7*c* and hence alter the flow paths of water therethrough.

In the first configuration shown in FIG. 1 the three-way valves 7*a*, 7*b*, 7*c* are configured such that each pump 2*a*, 2*b*, 2*c* is connected to its respective jetting leg section 3*a*, 3*b*, 3*c*. More specifically, the first pump 2*a* is only fluidly connected to the upper section 3*a*, the second pump 2*b* is only fluidly connected to the middle section 3*b* and the third pump 2*c* is only fluidly connected to the lower section 3*c*.

In use, the pumps 2*a*, 2*b*, 2*c* are activated and water is drawn through the intakes 4 to the inlets 20 of the pumps 2*a*, 2*b*, 2*c* via the feed lines 5. The water is pumped at an increased pressure out from the pump outlets 21, through the three-way valves 7*a*, 7*b*, 7*c*, and thence to the respective sections 3*a*, 3*b*, 3*c*. In this first configuration, full flow is provided to all three sections 3*a*, 3*b*, 3*c* of the jetting leg 3. As a result, a relatively high water flow rate is delivered at a moderate pressure from the outlets of the sections 3*a*, 3*b*, 3*c* of the jetting leg 3. This configuration is useful for cutting through substrates incorporating weak clays and loose sands, where such cutting may be achieved over a relatively wide area at any given time.

Figure 2:
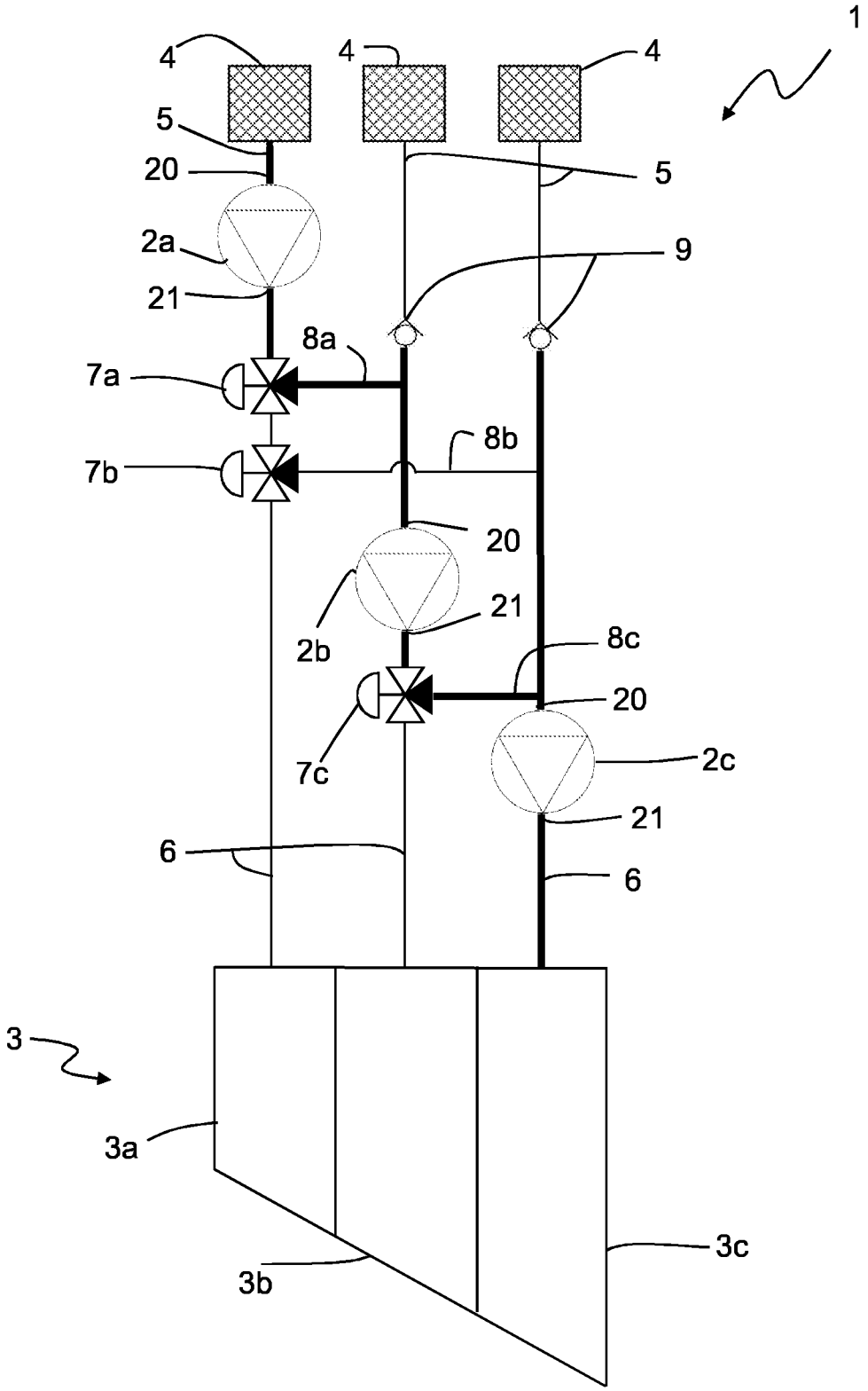
FIG. 2 is a schematic representation of the apparatus of FIG. 1 shown in a second mode of operation configured for cutting through substrates incorporating strong clays and hard soils.

Referring now to FIG. 2, the apparatus 1 of FIG. 1 is shown in a second configuration in which the first three-way valve 7*a* has been adjusted to divert all of the pressurised water from the outlet 21 of the first pump 2*a* to the inlet 20 of the second pump 2*b* via the first diversion line 8*a*. The third three-way valve 7*c* has also been adjusted to divert all of the pressurised water from the outlet 21 of the second pump 2*b* to the inlet 20 of the third pump 2*c* via the third diversion line 8*c*. The non-return valves 9 prevent pressurised water from travelling back to the intakes 4.

In the configuration of FIG. 2, the pumps 2*a*, 2*b*, 2*c* are in a series arrangement such that the pressure of flow delivered from the outlet 21 of the first pump 2*a* is augmented by the second pump 2*b* and the flow delivered from the outlet 21 of the second pump 2*b* is augmented by the third pump 2*c*. Accordingly, the pressure of flow delivered from the outlet 21 of the third pump 2*c* is a combination of the pressure generated in all three pumps 2*a*, 2*b*, 2*c*. The water pressure supplied to, and subsequently evacuated from, the lower section 3*c* is therefore significantly higher than in the configuration shown in FIG. 1.

Advantageously, the higher pressure water is useful to cut into adjacent substrates incorporating strong clays and hard soils, which might not otherwise be abraded by the lower water pressure delivered by the configuration of FIG. 1. However, in this second configuration the flow rate is reduced considerably and therefore a narrower area may be processed at any given time.

Figure 3:
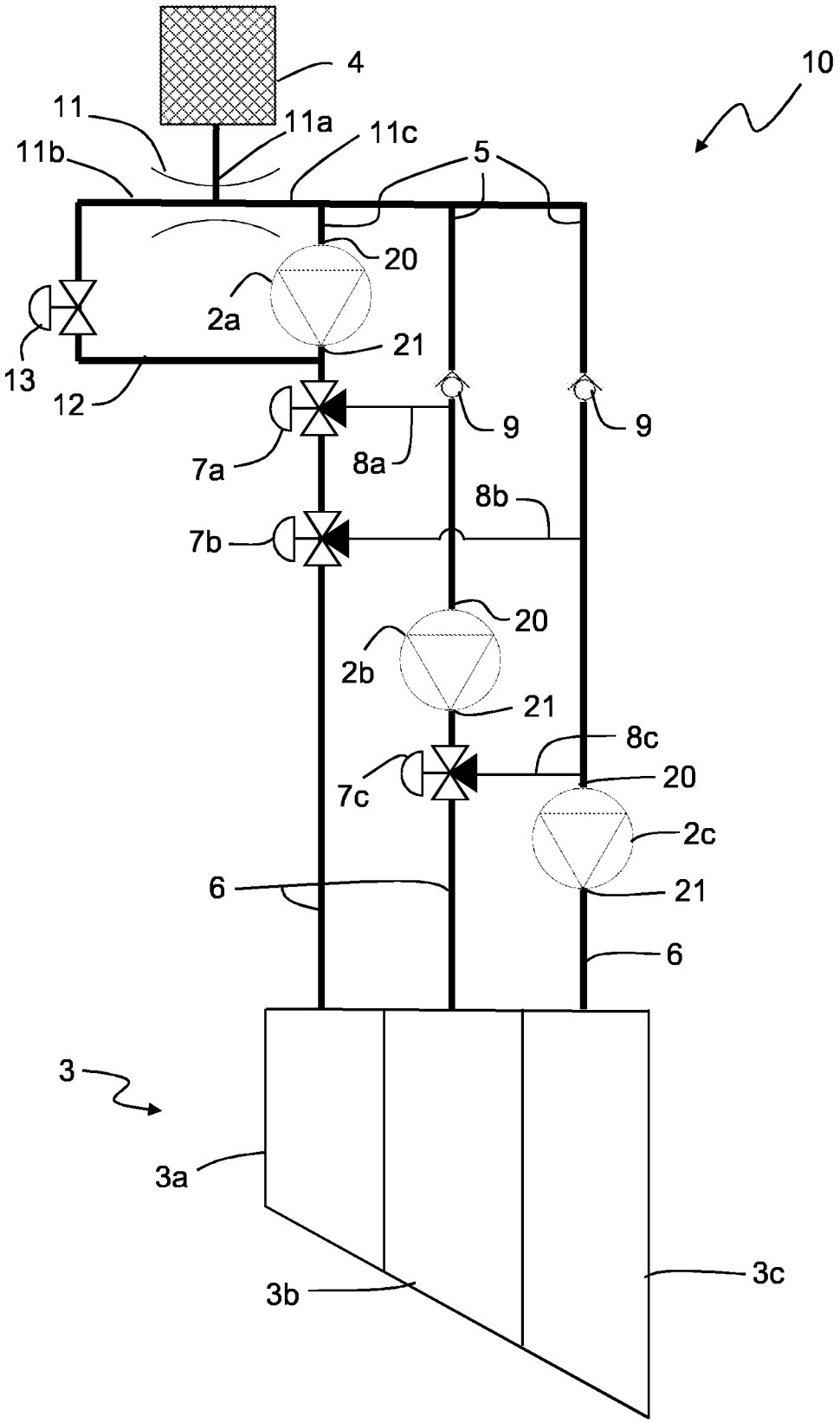
FIG. 3 is a schematic representation of an underwater trenching apparatus according to another embodiment of the invention shown in a first mode of operation configured for cutting through substrates incorporating loose sands and weak clays.

Referring now to FIG. 3, there is shown an underwater trenching apparatus 10 according to an alternative embodiment of the invention, where like features have like references and will not be described further. In this embodiment the underwater trenching apparatus 10 includes only one uptake 4, which is fluidly connected to the first inlet 11*a* of a jet pump 11.

The jet pump 11 also includes a second, intermediate inlet 11*b* and an outlet 11*c*. The second inlet 11*b* of the jet pump 11 is fluidly connected the outlet 21 of the first pump 2*a* via a regulating line 12. The output 11*c* of the jet pump 11 is fluidly connected to the feed lines 5 of each of the pumps 2*a*, 2*b*, 2*c*. The jet pump 11 provides a variable pressure boost to the water supplied to the inlets 20 of each of the pumps 2*a*, 2*b*, 2*c*, thereby significantly reducing the possibility of cavitation therein. A flow control valve 13 is also included in the regulating line 12 and is operably connected to the remotely located controller (not shown) via wired or wireless communication means.

In use, when the apparatus 10 is located in deep water the surrounding water pressure is relatively high and therefore the risk of cavitation within the pumps 2*a*, 2*b*, 2*c* is relatively low. Therefore, in deep water conditions the flow restricting valve 13 may be operated to close fluid communication between the outlet 20 of the first pump 2*a* and the input 11*b* of the jet pump 11.

Conversely, when the apparatus 10 is located in shallow water the water pressure is relatively low and therefore the risk of cavitation within the pumps 2*a*, 2*b*, 2*c* is relatively high. Therefore, in shallow water conditions the flow restricting valve 13 may be operated to open fluid communication between the outlet 21 of the first pump 2*a* and the input 11*b* of the jet pump 11 to bleed some of the higher pressure output flow from the first pump 2*a* into the jet pump 11 and hence prevent or reduce the incidence of cavitation.

In use, the configuration of the apparatus 10 shown in FIG. 3 delivers pressurised water to each of the sections 3*a*, 3*b*, 3*c*, in a similar manner to the configuration of the underwater trenching apparatus 1 shown in FIG. 1. As explained above, this arrangement is useful for cutting through adjacent substrates incorporating loose sands and weak clays.

Figure 4:
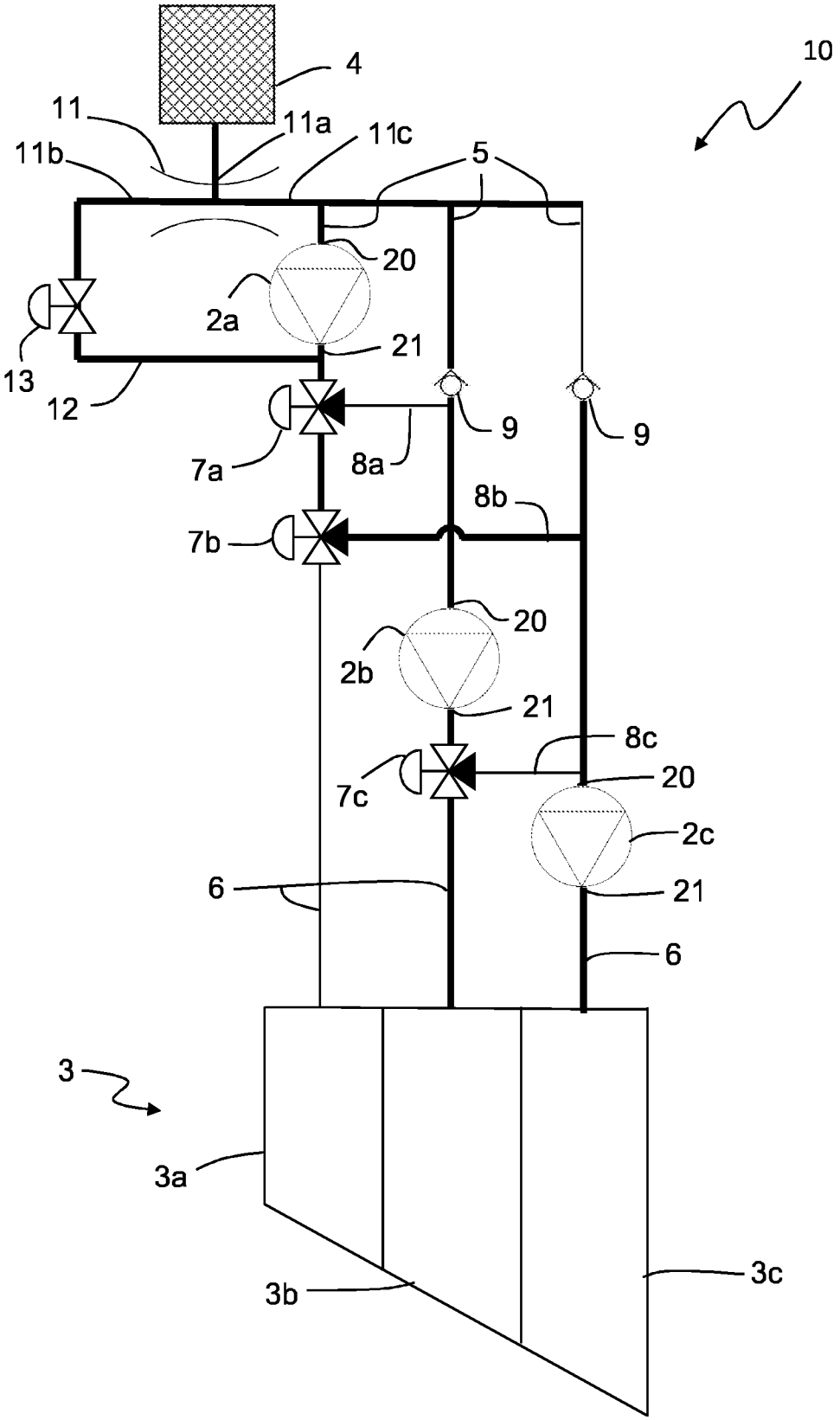
FIG. 4 is a schematic representation of the apparatus of FIG. 2 shown in a second mode of operation configured for cutting through substrates incorporating soft and intermediate clays and soils.

Referring now to FIG. 4, the apparatus 10 of FIG. 3 is shown with a different configuration. In this configuration, the second three-way valve 7*b* has been adjusted to divert all of the pressurised water from the outlet 21 of the first pump 2*a* to the inlet 20 of the third pump 2*c* via the second diversion line 8*b*. The second pump 2*b* remains unchanged and supplies fluid flow to the middle section 3*b* of the jetting leg 3. The second non-return valve 7*b* prevents pressurised water from travelling back to the output 11*c* of the jet pump 11.

Thus, the first and third pumps 2*a*, 2*c* are in a series arrangement, whereby the pressure of water pumped from the outlet 21 of the third pump 2*c* to the lower section 3*c* is a combination of pressures generated by the first and third pumps 2*a*, 2*c*. Meanwhile, the second pump 2*b* behaves as before and pumps pressurised water to the middle section 3*b* at a similar pressure to the configuration shown in FIG. 3. Water is not pumped to the upper section 3*a* in the configuration of FIG. 4.

Advantageously, the configuration of FIG. 4 provides an increased water pressure output from the lower section 3*c* in comparison with the configuration of FIG. 3. This increased water pressure output from the lower section 3*c* is suitable for cutting into adjacent substrates incorporating intermediate clays and soils. However, and at the same time, the middle section 3*b* continues to provide a pressurised water output, albeit at a lower pressure. In this way the middle section 3*b* may cut through adjacent substrates incorporating soft clays and soils. Usefully, this configuration increases the hardness of materials which may be cut by the apparatus 10 whilst maintaining, so far as possible, the rate with which trench cutting is achieved.

It will be appreciated by those skilled in the art that several variations to the aforementioned embodiments are envisaged without departing from the scope of the invention. For example, it will be appreciated that any useful configuration of the three-way valves 7*a*, 7*b*, 7*c* of the underwater trenching apparatus 1, 10 may be possible. For instance, the alternative embodiment of the apparatus 10 shown in FIG. 3 may have its three-way valves 7*a*, 7*b*, 7*c* adjusted in order to approximate the configuration of three-way valves 7*a*, 7*b*, 7*c* shown in FIG. 2 in relation to the first embodiment of the underwater trenching apparatus 1. Additionally or alternatively, the first embodiment of the underwater trenching apparatus 1 may have its three-way valves 7*a*, 7*b*, 7*c* configured in the manner described in relation to the alternative embodiment of the underwater trenching apparatus 10 shown in FIG. 4. The apparatus 1 according to the first embodiment may include one or more jet pumps 11 or other pressure boost means fluidly connected with one or more of the pumps 2*a*, 2*b*, 2*c*, with or without a check valve 13.

Although three pumps 2*a*, 2*b*, 2*c* are shown in the above embodiments this need not be the case and the underwater trenching apparatus 1, 10 may include only two pumps 2*a*, 2*b* or more than three pumps 2*a*, 2*b*, 2*c*, for example four, five or six pumps. Where the underwater trenching apparatus 1, 10 includes a different number of pumps 2*a*, 2*b*, 2*c* to the embodiments described above, it will be appreciated that the quantity of respective sections 3*a*, 3*b*, 3*c*, three-way valves 7*a*, 7*b*, 7*c*, one-way valves 9, feed lines 5, diversion lines 8*a*, 8*b*, 8*c* and delivery lines 6 will be consequently altered in concert therewith.

It is further envisaged and claimed that the apparatus need not include the jetting tool. For example, the present invention also relates to a pumping apparatus. The pumping apparatus may be used with jetting tools having more or less sections than the number of pumps comprised in the pumping apparatus. In such instances, the skilled person would appreciate the various connection arrangements possible.

Additionally or alternatively, the supply of pressurised water to one or more of the sections 3*a*, 3*b*, 3*c* of the jet cutting leg 3 may be further adjustably controlled by use of one or more constriction valves, for example where such constriction valves are included in the delivery lines 6. The constriction valves may be operatively connected to a remotely located controller which may adjust the constriction of the constriction valves in order to selectively reduce or increase the flow of pressurised water to one or more of the sections 3*a*, 3*b*, 3*c*. In this way the pressure and flow rate of pressurised water delivered by one or more of the pumps 2*a*, 2*b*, 2*c* may be selectively controlled.

Although the three-way valves 7*a*, 7*b*, 7*c* have been described above as being adjusted to divert or allow passage therethrough of all of the pressurised water this need not be the case. One or more of the three-way valves 7*a*, 7*b*, 7*c* may be adjusted in a step-wise or continuous manner such that a first portion of pressurised water delivered by one or more of the three-way valves 7*a*, 7*b*, 7*c* is passed therethrough and a second portion of the pressurised water is diverted to a diversion line 8*a*, 8*b*, 8*c*. Additionally or alternatively the three-way valves 7*a*, 7*b*, 7*c* may be manually adjustable.

Although the first embodiment of the underwater trenching apparatus 1 has been described as including separate uptakes 4 for each of the pumps 2*a*, 2*b*, 2*c* this need not be case. The apparatus 1 may include less than three uptakes 4, for example only one uptake 4 as described in relation to the alternative embodiment of the underwater trenching apparatus 10 shown in FIG. 3.

Additionally or alternatively, the jet cutting leg 3 of the underwater trenching apparatus 1, 10 may be removable and may be replaced, prior to use, by one or more alternative jet cutting legs 3, for example jet cutting legs 3 including more or less than three sections 3*a*, 3*b*, 3*c*. For example, an alternative jet cutting leg 3 may include only two sections 3*a*, 3*b*, an upper and a lower section 3*a*, 3*b*, and may have a shorter height than the jet cutting leg 3 described in the embodiment of FIG. 1. When the underwater trenching apparatus 1, 10 is provided with a jet cutting leg 3 having only two sections 3*a*, 3*b* one of the pumps 2*a*, 2*b*, 2*c* may be selectively prevented from pumping pressurised water towards the jet cutting leg, for example by a valve. Additionally or alternatively, where an underwater trenching apparatus 1, 10 includes more pumps 2*a*, 2*b*, 2*c* than sections 3*a*, 3*b*, 3*c* one or more of the three-way valves 7*a*, 7*b*, 7*c* may be adjusted to divert pressurised water from the output 21 of one or more pumps 2*a*, 2*b*, 2*c* towards the input 20 of a further pump 2*a*, 2*b*, 2*c*. In this way the quantity of pumps 2*a*, 2*b*, 2*c* which deliver pressurised water to sections 3*a*, 3*b*, 3*c* may be matched with the quantity of available sections 3*a*, 3*b*, 3*c*.

It will also be appreciated by those skilled in the art that any number of combinations of the aforementioned features and/or those shown in the appended drawings provide clear advantages over the prior art and are therefore within the scope of the invention described herein.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A pumping apparatus for use in an underwater trenching apparatus, comprising a first pump having an inlet for fluid connection through a first intake with a source of liquid and an outlet for fluid connection to the first section of a jetting tool and a second pump having an inlet for fluid connection through a second intake with a source of liquid and an outlet for fluid connection to the second section of a jetting tool, wherein the outlet of the first pump is fluidly connected to the inlet of the second pump by valve means that is operable to divert at least a portion of an outlet flow of the first pump from the first section of the jetting tool to the inlet of the second pump.

2. Apparatus as claimed in claim 1 comprising a third pump having an inlet for fluid connection with a source of liquid and an outlet fluidly connected to or for fluid connection with a third section of the or a jetting tool, wherein the outlet of the second pump is fluidly connected to the inlet of the third pump by the or a further valve means of the apparatus that is operable to divert at least a portion of an outlet flow of the second pump to the inlet of the third pump.

3. Apparatus as claimed in claim 1, wherein the or each valve means is adjustable, in use, to change or vary the proportion of the outlet flow that is diverted.

4. Apparatus as claimed in claim 1, wherein the or each valve means comprises a mixing valve.

5. Apparatus as claimed in claim 1, wherein the or each valve means is operable to close, in use, the fluid connection between the outlet of the pump and the relevant section of the jetting tool before or as a fluid connection is opened between the outlet of the pump and the inlet of the other pump.

6. Apparatus as claimed in claim 1, wherein the or each valve means comprises a directed flow or plug valve.

7. Apparatus according to claim 1 comprising control means operatively connected to and configured to control the or each pump.

8. Apparatus according to claim 7, wherein the or each valve means comprises a valve with an actuator that is operatively connected to and controllable automatically by the control means.

9. Apparatus as claimed in claim 2 comprising a check valve means having an inlet for fluid connection with the source and an outlet fluidly connected to the inlet of the second pump, wherein the check valve means is configured to allow fluid flow from the source to the inlet of the second pump and to prevent fluid flow to or toward the source.

10. Apparatus as claimed in claim 9 comprising a further check valve means having an inlet for fluid connection with the source and an outlet fluidly connected to the inlet of the third pump, wherein the further check valve means is configured to allow fluid flow from the source to the inlet of the third pump and to prevent fluid flow to or toward the source.

11. Apparatus according to claim 1 comprising a pressure boost means operatively connected to the inlet of each of the first and second pumps and operable, where the ambient pressure is insufficient substantially to prevent cavitation in the first or second pump, to locally increase the pressure at the inlet thereof.

12. Apparatus according to claim 11, wherein the pressure boost means comprises one or more jet pumps.

13. Apparatus according to claim 9, wherein the connection between the or each source and the or each pump or check valve means comprises an intake filter.

14. An underwater trenching apparatus comprising:

the pumping apparatus according to claim 1; and a trench-cutting jetting tool with first and second sections;

the outlet of the first pump being fluid connected to the first section of the jetting tool, the outlet of the second pump being fluidly connected to the second section of the jetting tool.

15. Apparatus as claimed in claim 1, wherein the valve means includes a three-way valve positioned on a delivery line connecting the first pump to the first section of the jetting tool, the three-way valve being fluidly connected to a feed line of the second pump via a diversion line.

16. Apparatus as claimed in claim 2, wherein the outlet of the first pump is fluidly connected to the inlet of the third pump by the or a further valve means of the apparatus that is operable to divert at least a portion of an outlet flow of the first pump to the inlet of the third pump.

17. Apparatus as claimed in claim 16, wherein the outlet of each of the first, second and third pumps is fluidly connected to respective section via a delivery line, wherein the valve means includes first and second three-way valves connected in series on the delivery line connecting the first pump to the first section, and, wherein the first three-way valve is fluidly connected to a feed line of the second pump via a first diversion line, and wherein the second three-way valve is fluidly connected to the feed line of the third pump via a second diversion line.

18. A method of operating an underwater trenching apparatus, the method comprising diverting at least a portion of the outlet flow of a first pump from the first section of a jetting tool to the inlet of a second pump fluidly connected to a second section of the jetting tool in order to increase the pressure of the outlet flow of the second pump supplied to the second section of the jetting tool, the first pump having a first intake and the second pump having a second intake.

19. Method according to claim 18 further comprising diverting at least a portion of the outlet flow of the second pump from the second section of the jetting tool to the inlet of a third pump fluidly connected to a third section of the jetting tool in order to increase the pressure of the outlet flow of the third pump supplied to the third section of the jetting tool.

20. Method according to claim 18 comprising diverting only some of the outlet flow of the first pump such that a portion of the outlet flow is supplied to the first section of the jetting tool and a further portion of the outlet flow is supplied to the inlet of the second pump.

21. Method according to claim 18 comprising varying the proportion of the outlet flow that is diverted in response to a command received by a user and/or according to varying requirements.

22. Method according to claim 18 comprising diverting the outlet flow portion of one or more of the pumps using a control means.

23. Method according to claim 18 comprising increasing locally the pressure of a fluid flow to the inlet of the first and/or second pump to inhibit cavitation thereof or therein.

24. A computer program element comprising computer readable program code means for causing a processor to execute a procedure to implement a method according to claim 18.

25. A computer readable medium having a program stored thereon, where the program is arranged to make a computer execute a procedure to implement a method according to claim 18.

* * * * *